United States Patent [19]

Shima

[11] Patent Number: 4,526,017

[45] Date of Patent: Jul. 2, 1985

[54] KNITTING DENSITY ADJUSTING METHOD

[75] Inventor: Masahiro Shima, Wakayama, Japan

[73] Assignee: Shima Idea Center Co., Ltd., Wakayama, Japan

[21] Appl. No.: 559,475

[22] Filed: Dec. 8, 1983

[30] Foreign Application Priority Data

Dec. 11, 1982 [JP] Japan ..... 57-217251

[51] Int. Cl.[3] ..... D04B 7/00

[52] U.S. Cl. ..... 66/71; 66/75.2; 66/78

[58] Field of Search ..... 66/71, 78, 75.2

[56] References Cited

U.S. PATENT DOCUMENTS 1,571,766 2/1926 Fels ..... 66/71 X
3,035,426 5/1962 MacQueen ..... 66/75.2 X
3,550,400 12/1970 Peat et al. ..... 66/110 X
3,771,329 11/1973 Krause ..... 66/78

FOREIGN PATENT DOCUMENTS 2129439 3/1971 France ..... 66/71

*Primary Examiner*—Ronald Feldbaum
*Attorney, Agent, or Firm*—Moonray Kojima

[57] ABSTRACT

A method of adjusting the knitting densities of respective courses when a flat knitted fabric is to be produced. The knitted yarn length having been used in the reference section is compared in the subsequent knitting operation with the reference yarn length to actuate the knitting density drive unit on the basis of the compared values so that the knitting cam is so rose or lowered as to increase or decrease the knitting density and the comparisons of the reference yarn length and the knitted yarn length are compared until the two lengths become coincident.

6 Claims, 3 Drawing Figures

KNITTING DENSITY ADJUSTING METHOD

BACKGROUND OF THE INVENTION

The present invention relates to a knitting density adjusting method and, more particularly, to a method of adjusting the knitting densities of respective courses when a flat knitted fabric is to be produced.

If the knitting cams of a lock are positioned at an equal height at righthand and lefthand sides during the rightward and leftward strokes of a carriage when a knitted fabric is to be produced by a flat knitting machine, the knitting density of the stitches made during the leftward stroke of the carriage is not identical to that of the stitches made during the rightward stroke of the carriage. This is considered to come from the following reasoning. Specifically, when the carriage is transferred, in case a feed source of yarns such as a bobbin is disposed at one side of the frame of the knitting machine, to the opposite side from the yarn feed source, it is transferred, while pulling out the yarn from the bobbin or the like, to apply a tension to the yarn. When the carriage is turned at the end portion of the knitting machine so that it approaches the yarn feed source, the yarn is already pulled out so that the knitting operation is conducted by the use of said pulled-out yarn, whereby no tension is applied to the yarn. On the other hand, even in case the yarn feed sources such as the bobbins are disposed at both the sides of the machine frame so that the yarns are pulled out from the bobbins at the two sides and are fed to one feeder, the tensions to the yarns are delicately different for the rightward and leftward strokes of the carriage so that there arises a difference in the knitting density between the rightward and leftward knitting strokes of the knitted fabric. This results in a difference in the consumption rate of the yarns between the rightward and leftward strokes of the carriage. This difference is not clear just at a glance of the knitted fabric if it is several percentages. The good appearance of the knitted fabric, however, is deteriorated if the difference increases.

On the other hand, there is a tendency that the knitting density increases for the increase in the knitting speed of the knitting machine. As a result, if the knitting speed is changed during the knitting operation, the knitting density is accordingly changed so that knitting irregularities are caused in the courses of the knitted fabric produced.

Moreover, in case there is difference in the lengthes of the knitting yarns for knitting the respective courses, as has been described in the above, it is impossible to know in advance the length of the knitting yarn of one garment, and still the worse it becomes difficult to knit a fabric with patterns unless excess amount of dyed yarns is prepared for the knitting.

SUMMARY OF THE INVENTION

An object of the present invention is to provide a method for adjusting the knitting densities of respective courses of a flat knitted fabric.

Further object of the present invention is to eliminate any irregularity of the knitting densities of the courses by making constant the length of the knitted yarn forming each course.

According to the present invention, there is provided a knitting density adjusting method characterized: in that the yarn length of the reference course, which is fed to the needles of the reference section on the needle floor, is used as the reference yarn length; in that the knitted yarn length having been used in the reference section is compared in the subsequent course knitting operation with the reference yarn length to actuate the knitting density drive unit on the basis of the compared values so that the knitting cam is so rose, when the knitted yarn length is shorter than the reference yarn length, as to increase the knitting density and is so lowered, when the knitted yarn length is longer than the reference yarn length, as to decrease the knitting density; and in that the comparisons of the reference yarn length and the knitted yarn length are compared until the two lengthes become coincident. As a result, during the knitting operation, the knitted yarn length for knitting the respective courses can be so compensated at all times as to approach the reference value so that the knitted cloth having its respective courses uniformly knitted can be attained.

DETAILED DESCRIPTION OF THE INVENTION

The present invention will be described in the following with reference to the accompanying drawings in connection with one example of a system for practising the method of the present invention.

Figure 1:
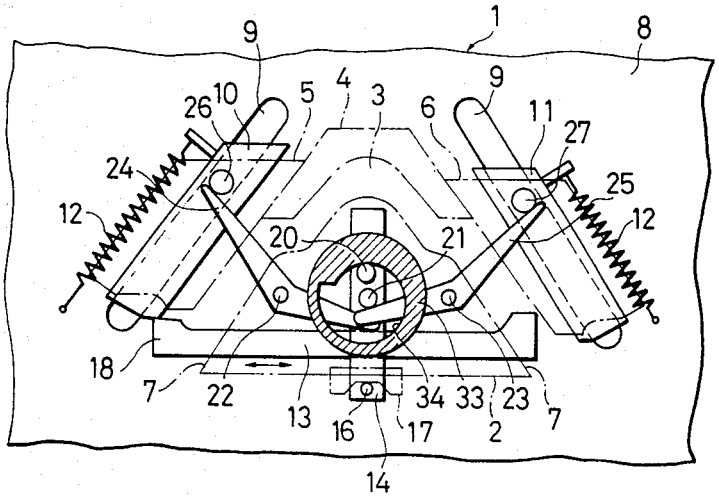
FIG. 1 is a top plan view showing the lock.
Figure 2:
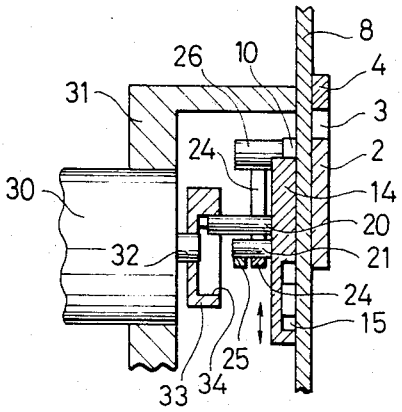
FIG. 2 is a sectional view showing the central portion of the lock.

FIG. 1 schematically shows a lock 1. This lock 1 is disposed in one set or in a necessary number of sets in the carriage. The following description will be made upon one set of the lock because the construction and operation of the present invention are identical for the one set.

Indicated at reference numeral 2 is a raising cam, in which a guard cam 4 and knitting cams 5 and 6 are arranged through a passage 3 of a butt (not shown), at the top and at the lefthand and righthand sides, respectively. The knitting cams 5 and 6 are fixed in parallel with the slopes 7 and 7 of the raising cam 2 on sliding members 10 and 11 which in turn are fitted obliquely slidably in grooves 9 formed in the base plate 8 of the carriage. The knitting cams 5 and 6 are so biased as to be pulled down by springs 12 which are spread between the sliding members 10 and 11 and the base plate 8, respectively. Indicated at reference numeral 13 is a sliding member stopper which is supported in a manner to slide to the right and left on the base plate 8 by the coactions of a not-shown guide member disposed on the base plate 8 and a guide groove 15 formed in a lifting lever 14. If the knitting cam 5 is to be lowered when the sliding member 13 has been moved leftward, the sliding member stopper 13 abuts against the lower end of the sliding member 10 of the knitting cam 5 thereby to stop the downward movement of the knitting cam 5. If the knitting cam 5 is to be lowered when the sliding member 13 has been moved rightward, the sliding member stopper 13 abuts against the lower end of the sliding member 11 of the knitting cam 6 thereby to stop the downward movement of the knitting cam 6. The lifting lever 14 is slidably supported on the base plate 8 by means of a not-shown member and is equipped with roll pins 20 and 21. Rocking arms 24 and 25 are supported at the lefthand and righthand sides of the lifting lever 14 in a rocking manner by means of pivot pins 22 and 23 which are anchored at the base plate 8. The rocking arms 24 and 25 have their upper end portions abutting against roll pins 26 and 27, which are disposed in the sliding members 10 and 11, respectively, and have their lower end portions made movable to and from the roll pin 21. Since, in the construction described in the above, the sliding members 10 and 11 are biased downward by the springs 12, the rocking arm 24 is urged to turn counter-clockwise through the roll pin 26 whereas the rocking arm 25 is urged to turn clockwise through the roll pin 27. At this time, if the end portion of the sliding member stopper 13 comes into abutment contact with the lower end of the sliding member 10, for example, the sliding member 10 is blocked from its lowering movement, but only the sliding member 11 is allowed to be lowered so that only the rocking arm 25 is turned clockwise to cause only the lower end of the rocking arm 25 and the roll pin 21 to contact with each other but the roll pin 21 and the lower end of the rocking arm 24 to release each other.

Indicated at reference numeral 30 is a pulse motor which is supported on the base plate 8 by means of a support member 31 and which has its shaft 32 equipped with a cam 33. This cam 33 has its recessed wall providing a cam face 34, against which the pin 20 abuts. The contact pressure of the pin 20 with the cam face 34 is based upon the elastic force of the spring 12.

As a result, when the cam 33 is turned by the pulse motor 30, the roll pin 20 inscribed in the cam 33 is moved up or down to have its position regulated so that the lifting lever 14 is accordingly moved up or down. As a result, the roll pin 21 rocks the rocking arm 24 or 25 in accordance with the position of the roll pin 20 so that the sliding members 10 and 11 are moved down by the elastic forces of the springs 12 or up against the same elastic forces through the roll pins 26 and 27.

The mechanism for controlling the rotations of the pulse motor 30 will be described in the following.

Figure 3:
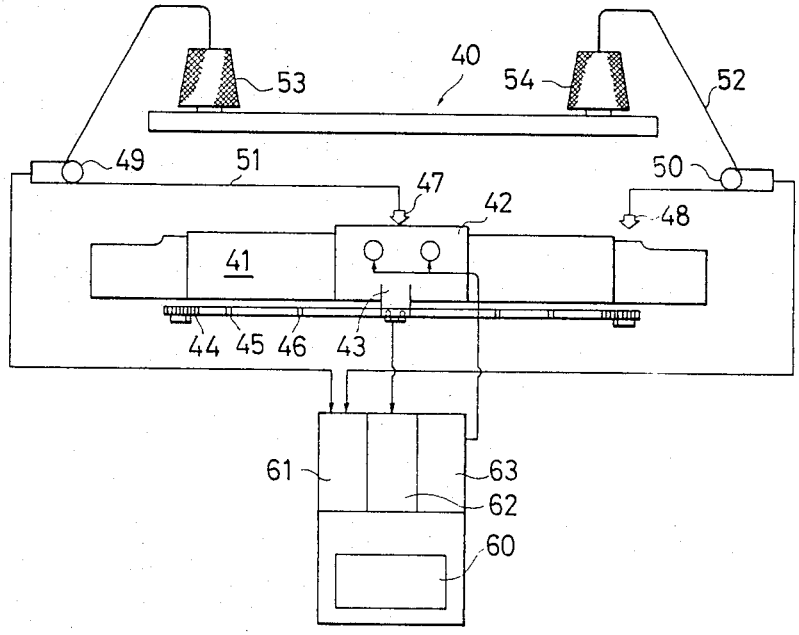
FIG. 3 is a block diagram showing the flat knitting machine and the control system therefor.

Indicated at reference numeral 40 in FIG. 3 is a flat knitting machine, in which a carriage 42 is reciprocated to the right and left along the upper face of a needle bed 41 having a flat or angular shape. The carriage 42 is equipped, in the shown example, with two sets of the aforementioned locks 1 on its needle bed and with a needle pitch sensor 43. In parallel with the needle bed 41, there is disposed a needle pitch indicating member 44, which is located by the needle pitch sensor 43 made to reciprocate with the movement of the carriage. The needle pitch indicating member 4 is formed with marks 45 and 46 for determining the range of measurement of the yarn length for the later-described yarn length measurement. Indicated at numerals 47 and 48 are feeders which are identical to such well-known mechanism as can move together with the carriage 42 in accordance with the movement of the carriage 42 while being retained on the carriage 42. Numerals 49 and 50 indicate pulse encoders for yarns 51 and 52, and numerals 53 and 54 indicate packages for yarn feed sources. In the embodiment thus far described, the yarn feed sources 53 and 54 and the pulse encoders 49 and 50 are arranged at both the lefthand and righthand sides of the machine frame, but it is quite natural that they may be disposed only at one side of the machine frame. The pulse encoders 51 and 52 are used to measure the lengthes of the yarns and to generate one or a predetermined number of pulses for each rotation, and their signals are fed to an encoder control unit 61. The output of the needle pitch sensor 43 of the carriage 42 is inputted to a needle pitch sensor control unit 62.

A main control unit 60 receives the signals from the encoder control unit 61 and the needle pitch sensor control unit 62 and outputs a signal to a knitting density drive unit 63. The encoder control unit 61 receives the signals, which have measured the yarn lengthes on the basis of the pulse numbers outputed by the pulse encoders 49 and 50, and compares them with the pulse number for a predetermined reference yarn length. On the basis of those data, the signal for driving the knitting density drive unit 63 is outputed from the main control unit 60. The needle pitch sensor 62 detects a reference section for measuring the yarn lengthes on the basis of the marks 45 and 46 of the needle pitch indicating member 44.

Next, the operations of the method of the present invention will be described in the following.

First of all, the mechanical operations for moving up and down the knitting cam 6 so as to adjust the knitting density will be described. The pulse motor 30 for actuating the knitting cam 6 is suitably changed, as will be described hereinafter, by the measured values of the lengthes of the knitted yarns which have been used for the knitting operations in the reference course. This change is conducted by turning the cam 33 through a rotation of such a predetermined angle of the pulse motor 30 as is based upon the aforementioned measured values.

FIG. 1 shows the state of the lock 1 in case the carriage 42 is moved from the left to the right.

At the end of the rightward stroke of the carriage 42, the cam member 17 exerts its action upon the roll pin 16, which is anchored at the lifting lever 14, to push down the roll pin 16 downwardly in FIG. 1 thereby to slide the lifting lever 14 downwardly in FIG. 1. As a result, the rocking arms 24 and 25 rocked through the roll pin 21 of the lifting lever 14 so that the sliding members 10 and 11 are rose against the elastic forces of the springs 12 through the roll pins 26 and 27 which are in engagement with the leading ends of the rocking arms 24 and 25.

Next, the sliding member stopper 13 is pushed to the left, as shown in FIG. 1, by a not-shown mechanism to bring the lefthand end of the sliding member stopper 13 to below the sliding member 10. Moreover, when the aforementioned cam member 17 is moved to the center, as shown in FIG. 1, the lifting lever 14 is rose, because it receives the elastic forces of the springs 12 through the roll pins 26 and 27, the rocking arms 24 and 25 and the roll pin 21, and is stopped as a result that the roll pin 20 integrated with the lifting lever 14 abuts against the cam face 34 of the cam 33. Simultaneously with this, the sliding members 10 and 11 are lowered, but, since at this time the sliding member stopper 13 is pushed leftwardly in FIG. 1 by the not-shown mechanism, the leftend portion 18 of the sliding member stopper 13 is positioned below the sliding member 10 so that is comes into abutment against the lowered sliding member 10 thereby to block the further downward movement of the same. As a result, the knitting cam 5 made integral with the sliding member 10 is stopped while being blocked from its downward movement. On the other hand, the sliding member 11 is moved down by the elastic forces of the springs 12, but, since the lifting lever 14 is stopped with the roll pin 20 being abutting atainst the cam face 34 of the cam 33, as has been described in the above, the sliding member 11 cannot be lowered any more thereby to position the knitting cam 6 made integral with the sliding member 11.

As has been described hereinbefore, the lower positions of the knitting cams 5 and 6 are determined by the position of the lifting lever 14, and the stop position of the lifting lever 14 is determined by the abutting positions of the roll pin 20 and the cam face 34. As a result, the position of the knitting cam 6, i.e., the height of the same to be positioned in accordance with the level of the knitting density is determined by the abutting positions of the cam face 34 of the cam 33 and the roll pin 20 of the lifting lever 14.

The cam 33 is turned by the pulse motor 30, and its angle of rotation is determined by the number of the pulses inputed to the pulse motor 30.

In the present invention, the length of the knitted yarn of the knitted fabric, which has been made between the predetermined needles of the reference course, is referred so that, when a subsequent course is knitted, the knitting cam is moved to decrease the knitting density when the same knitting cam is to knit the subsequent course, if the length of the knitted yarn used between the predetermined needles of said course is longer than the aforementioned reference, and to increase the knitting density if the length of the knitted yarn used is shorter than the reference.

In FIG. 3, the yarn 51, which is pulled out of the package 53 and fed through the feeder 47 to the needle (although not shown) of the needle bed 41, is retained midway of its way by the pulse encoder 49 to turn this encoder 49 so that the yarn length is measured. The measured signal of the yarn length is inputed to the encoder control unit 61. In this encoder control unit 61, it is compared whether the measured yarn length is longer or shorter than the reference yarn length.

More specifically, when the carriage is reciprocally moved in the flat knitting machine, the yarns are alternately fed by the feeder in the two directions, i.e., to the right and left with respect to the knitted fabric. However, since the yarn knitted in the rightward stroke of the carriage and the yarn knitted in the leftward stroke of the carriage are different in the lengthes between predetermined wales in the knitted cloth, the height of the knitting cam in the rightward stroke of the carriage and the height of the knitting cam in the leftward stroke have to be made different. For this requirement, the length of the knitted yarn, which has been used to knit the course in the same direction as that of the course to be knitted, has to be referred to. As a result, the reference becomes different when the carriage is moved to the right and to the left.

In accordance with the movement of the carriage 42, on the other hand, the needle pitch sensor 43 made integral with the carriage 42 locates the needle pitch indicating member 44 juxtaposed to the needle bed 41 and to detect the marks 45 and 46, which are attached to the needle pitch indicating member 44, thereby to input to the needle pitch sensor control unit 62 the signal indicating whether the carriage has stealed into the measured yarn length section (or the reference section) or not.

In the above: the yarn length knitted into the reference section is designated at X; the knitted yarn length is designated at Xp in terms of the number of pulses; the number of pulses measured by the pulse encoders is designated at P; the number of pulses generated for one rotation of the encoders is designated at Z; the diameter of the encoders is designated at D; the number of the needles between a predetermined section is designated at N; and the number of gauges is designated at G. Let the case be considered in which the pulse encoder is placed for the yarn feeding operation at the lefthand side of the frame of the flat knitting machine.

The yarn length X is expressed when the carriage is moved from the left to the right (i.e., in the direction of A):

$$X = P\left(\frac{D}{Z}\right) - N\left(\frac{25.4}{G}\right). \tag{1}$$

The yarn length X is expressed when the carriage is moved from right to the left (i.e., in the direction of B):

$$X = P\left(\frac{\pi D}{Z}\right) + N\left(\frac{25.4}{G}\right). \tag{2}$$

In case the yarn length is expressed in terms of pulses, for the movement of the carriage from the left to the right (i.e., in the direction of A):

$$X_P = P - \left(\frac{25.4N}{G} \cdot \frac{Z}{\pi D}\right), \text{ and} \tag{3}$$

for the movement of the carriage from right to the left (i.e., in the direction of B):

$$X_P = P + \left(\frac{25.4N}{G} \cdot \frac{Z}{\pi D}\right). \tag{4}$$

By way of example, in case P (taken in the direction A)=1,000, P (taken in the direction B)=420, Z=100, N=100, D=40 and G=7;

in the direction A:

$$X = P\left(\frac{\pi D}{7}\right) - N\left(\frac{25.4}{G}\right)$$

$$= 1{,}000\left(\frac{\pi \cdot 40}{100}\right) - 100\left(\frac{25.4}{7}\right) = 894 \text{ mm; and}$$

in the direction B:

$$X = P\left(\frac{\pi D}{Z}\right) + N\left(\frac{25.4}{G}\right)$$

$$= 420\left(\frac{\pi \cdot 40}{100}\right) + 100\left(\frac{25.4}{7}\right) \text{ 891 mm.}$$

Thus, the knitted yarn has the different lengthes for the knitting operations in the directions A and B. In case of the knitted yarn length is 894 mm, the length of one loop to be made by one needle is 9.94 mm because the number of the needles is 100. By one step of the pulse motor 30 for the knitting density control, moreover, the knitting cams 5 and 6 are moved by about 0.1 mm in terms of their vertical strokes, and the length of one loop is shortened by 0.2 mm for one step-up and elongated by 0.2 mm for one step-down. As a result, in case the reference length is set at 894 mm, the pulse motor for the knitting density control may be stepped up by one if the length X of the actually knitted yarn is 884 mm and down by one if the yarn length X is 904 mm.

In the operations thus far described, the signals of the encoder control unit 61 and the needle pitch sensor control unit 62 are analyzed by the main control unit 60, and the signal of this main control unit 60 is received by the knitting density drive unit 63 to suitably rotate the pulse motor 30.

The aforementioned operations will be summarized in the following: (1) the measurement starting istruction is inputed to the needle pitch sensor control unit 62, and the number of the encoder pulses is simultaneously inputed to the encoder control unit 61 as a result that the portion of the mark 45 of the needle pitch indicating member 44 is passed by the carriage in accordance with the progress of the carriage; (2) reference is made to the reference value which is stored in advance in the encoder control unit 61; (3) when the knitted yarn length fails to coincide, the knitting density drive unit 63 is instructed by a compensated value through the main control unit 60 after the reference; and (4) the compensated value is inputed from the knitting density drive unit to the knitting density control pulse motor thereby to adjust the heights of the knitting cams 5 and 6. Next, the aforementioned steps (1) and (2) are repeated again, and the steps (3) and (4) are also repeated unless the yarn length fails to coincide with the reference. Moreover, if the yarn length becomes coincide with the reference after the thrice repetition of the steps (1) and (2), the knitting operation is thereafter continued in that state.

What is claimed is:

1. A knitting density adjusting method, comprising the steps of feeding a reference length of yarn as a reference course to needles of a reference section disposed on a needle bed;

comparing a knitting yarn length used in said reference section, to said reference yarn length, in a subsequent knitting operation;

actuating a knitting density drive unit to raise a knitting cam when said knitting yarn length is shorter than said reference yarn length to increase knitting density;

actuating said knitting density drive unit to lower said knitting cam when said knitting yarn length is longer than said reference yarn length to decrease knitting density; and continuing the comparing of said reference yarn length and said knitting yarn length until both become coincident.

2. The method of claim 1, wherein said knitting yarn length is measured in said reference section by pulse encoders.

3. The method of claim 1, wherein said knitting density drive unit generates signals to rotate a motor to drive said knitting cam.

4. A knitting density adjusting device for a flat knitting machine including a lock where a pair of knitting cams (5, 6) fixed on sliding members (10, 11) which are fitted slidably in grooves (9, 9) formed in a base plate (6) of a carriage, are disposed at both sides of a raising cam (2), characterized in that it comprises:

a pulse motor (30);

a cam (33) provided on a shaft (32) of the pulse motor (30) and having a cam face (34);

a lifting lever (14) which is slidably supported on the base plate (8) and is equipped with a first roll pin (20) and a second roll pin (21), said first roll pin being abutted against the cam face (34); and a pair of rocking arms (24, 25) which are supported by pivot pins (22, 23) anchored at the base plate (8), one end portions of each of said rocking arms (24, 25) being abutted against roll pins (26, 27) which are disposed in the sliding members (10, 11), respectively, and another end portions of each of said rocking arms (24, 25) being made movably to and from the second roll pin (21).

5. A knitting density adjusting device as set forth in claim 4, characterized in that a sliding member stopper (13) which is supported to slide to the right and left on the base plate (8) and may abut against one of the lower ends of the sliding members (10, 11) of the knitting cams (5, 6) to stop the downward movement of the knitting cams (5, 6).

6. A knitting density adjusting device as set forth in claim 4 or 5, characterized in that a control means for inputting a signal for adjusting the knitting density to the pulse motor is further provided and comprises:

a pulse encoder (49) for measuring the knitted yarn length;

an encoder control unit (61) for comparing whether the measured yarn length is longer or shorter than the reference yarn length;

a needle pitch sensor control unit (62) which receives a signal from a needle pitch sensor (43) made integral with the carriage (42);

a main control unit (60) for analyzing the signals of the encoder control unit (61) and the needle pitch sensor control unit (62); and a knitting density drive unit (63) which receives a signal of the main control unit (60) and drives the pulse motor (30) to adjust the height of the knitting cams (5, 6).

* * * * *